US006073310A

United States Patent [19]

Baer

[11] Patent Number: 6,073,310

[45] Date of Patent: Jun. 13, 2000

[54] TORQUE RESISTANT HINGE BEARING

[76] Inventor: Austin R. Baer, 24416 Highway 550, Ridgway, Colo. 81432

[21] Appl. No.: 08/916,640

[22] Filed: Aug. 22, 1997

[51] Int. Cl.[7] ..... E05D 7/00

[52] U.S. Cl. ..... 16/354

[58] Field of Search ..... 16/354

[56] References Cited

U.S. PATENT DOCUMENTS

| | | | |
|---|---|---|---|
| 3,092,870 | 6/1963 | Baer | 16/128 |
| 3,402,422 | 9/1968 | Baer | 16/354 |
| 3,499,183 | 3/1970 | Parsons | 16/136 |
| 3,787,923 | 1/1974 | Peterson | 16/184 |
| 3,921,225 | 11/1975 | Suska | 16/136 |
| 3,999,246 | 12/1976 | Suska | 16/136 |
| 4,097,959 | 7/1978 | Johnson | 16/136 |
| 4,284,861 | 8/1981 | Senften | 200/61.7 |
| 4,419,788 | 12/1983 | Prout | 16/300 |
| 4,583,262 | 4/1986 | Werner | 16/300 |
| 4,679,277 | 7/1987 | Shibata | 16/354 |
| 4,761,853 | 8/1988 | Hoffman | 16/302 |
| 4,976,008 | 12/1990 | Baer | 16/354 |
| 4,996,739 | 3/1991 | Baer | 16/354 |
| 4,999,878 | 3/1991 | Baer | 16/354 |
| 4,999,879 | 3/1991 | Baer | 16/354 |
| 4,999,880 | 3/1991 | Baer | 16/354 |
| 5,001,810 | 3/1991 | Baer | 16/302 |
| 5,685,045 | 11/1997 | Lace | 16/354 |

FOREIGN PATENT DOCUMENTS

| | | | |
|---|---|---|---|
| 1448729 | 8/1966 | France | 16/234 |
| 24 57 413 | 6/1975 | Germany | 16/353 |

OTHER PUBLICATIONS

Roton Continous Hinge Brochure, 1989, Roton Corporation.
Hager Hardware Brochure, 08710/HAG Buyline 3643, Hager Hinge Company.

*Primary Examiner*—Anthony Knight
*Assistant Examiner*—Alison K. Pickard
*Attorney, Agent, or Firm*—Pennie & Edmonds LLP

[57] ABSTRACT

Two hinge members are pivotally mounted about edges of a clamp. Thrust bearings are disposed in recesses in both hinge members for preventing relative movement between the hinge members along the clamp length. Antirotation portions of the bearings resist rotation of the bearings caused by torque produced by the hinge members on the bearings. In one embodiment, the clamp has a longitudinal key that is engaged within a keyway in the bearings that prevents bearing rotation. In another embodiment, the bearings have a longitudinal free extension on at least one side of a bearing body. The extensions increase the effective length of the bearings, limiting rotation. The extensions are preferably meshable with other bearings for transferring torque between adjacent bearings, or bearings may overlap the extensions. More preferably, the extensions are lockable to other bearings. The clamp may have notches extending between its walls and a clamp base such that the clamp base remains unaltered upon bending of the walls. Additionally, the thrust bearings may have lateral free extensions that increase the width of the bearing and that have a smaller width once mounted within the clamp to reduce gaps therebetween.

38 Claims, 7 Drawing Sheets

TORQUE RESISTANT HINGE BEARING

FIELD OF THE INVENTION

The present invention relates to hinges having thrust bearings that prevent relative longitudinal movement along pivoting axes of hinge members. More particularly, the invention relates to hinges in which two hinge members are mounted to a clamp and the clamp and thrust bearings are configured to prevent rotational displacement of the bearings perpendicular to the axes of rotation of the hinges caused by an opposite loading of each hinge member.

BACKGROUND OF THE INVENTION

Hinges are known with two pivotably connected hinge members for pivotably connecting two objects, such as a door and a door frame, and with thrust bearings that prevent relative movement between the hinge members along their axes of rotation. U.S. Pat. No. 3,402,422, for example, teaches a continuous hinge with two hinge members mounted rotatably about edges of a C-shaped, elongated clamp that defines an internal channel. Gear segments at edges of the hinge members are meshed with each other. One or more thrust bearings disposed in recesses of both hinge members prevent relative longitudinal movement of the hinge members along their axes of rotation. The bearings occupy most of the cross-sectional space within the clamp and have bearing surfaces on their ends that are generally parallel to, abut, and support the recess end surfaces of the hinge member recesses. The general profile of these bearings is shaped to receive the clamp edges about which the hinge members are mounted. Another configuration of a continuous hinge is taught in U.S. Pat. No. 4,999,879, which discloses hinge members with gear segments meshed with the clamp instead of, or in addition to, being meshed with each other.

During normal use, one hinge member usually supports the other via the bearings as, for example, when a door hangs from one hinge member and a wall supports the other. In this condition, the hinge members are biased in opposite longitudinal directions along the clamp length. As a result, the hinge members apply opposite forces to each side of the bearings. The bearings thus tend to twist within the clamp member, forcing the bearing surfaces out of parallel with respect to the recess surfaces. Due to the decreased area of twisted bearings supporting the hinge members, hinge wear is accelerated and unwanted longitudinal displacement occurs between the hinge members causing the door to sag. This affects the alignment of the lockset and other door hardware which may be attached, such as automatic door closers and the like. Further, gaps form between the bearing and the hinge members that decrease sealing against liquids or gasses between the bearings and the hinge members.

Ordinarily, a close fit between the cross-sections of the thrust bearings and the clamp resist this bearing twisting. Certain design considerations, however, restrict the provision of this desired close fit. For example, an allowance between the dimensions of the bearings and the clamp must be provided to permit hinge assembly by sliding the clamp over the geared ends of the hinge members with the bearings already in place within the recesses. Also, variations in the forming processes employed to manufacture different parts of the hinge hinder the attainment of uniform parts and precision fits, particularly in long continuous hinges. The spacing between the clamp ends about which the hinge members pivot is also subject to variation as the clamp must accommodate irregularities in the cross-section of the hinge members. The hinge member cross-sections also deviate due to anodizing or paint coatings of various thicknesses. Clamp members must thus be manufactured to accommodate a wide range of hinge-member gear cross-sections. In addition, the clamp itself may become bowed upon manufacturing or installation, and in some applications, loose-fitting clamp members may be desirable to facilitate friction-free hinge motion or the easy assembly of particularly long lengths.

Further exacerbating the decreased resistance of the bearings to twist within hinges built for high load applications, numerous, longitudinally short bearings are employed in order to spread the elevated loads over as many bearing surfaces as possible, which can decrease the pressure and friction on each bearing. Such short thrust bearings are even more prone to undesirable rotational displacement within the clamp member than longer bearings because the bearings must travel through a greater angular arc to cover the same distance before the sides of the bearings contact the clamp, stopping further rotation. In some arrangements, the requisite clearance between the ends of the clamp member and the bearing profile described above, coupled with bearings which are not long enough to contact a clamp wall even after moderate rotation, the bearing rotation stops when the bearings are compressed between two opposing corners of a pair of recesses.

U.S. Pat. No. 4,999,878 teaches an integral thrust bearing assembly in which multiple thrust bearing bodies are rigidly connected by webs. This arrangement increases the overall length of the assembly, better resisting twisting of the individual bearings within the clamp member, but the arrangement does not take advantage of the additional space within the clamp between each such assembly, and has certain limitations imposed by the requirement that recesses in the hinge members must be machined in the same multiples required by each such bearing unless other steps are taken to provide single or multiple bearings of other multiples.

Continuous hinges are also known in which a short lip protrudes from each longitudinal end of the bearings within the clamp. An example of this is shown in FIG. 4 of the '878 patent, although these lips are most often used with single bearing bodies. A similar lip can also be seen in FIGS. 10 and 11 of U.S. Pat. No. 4,976,008. The lips protrude just far enough so that they do not fit through the recesses in which the bearing body is to be placed. These lips facilitate assembly of the hinge because they permit a hinge builder to join two hinge members and position the bearing into the aligned recesses until the lip contacts a portion of the radius of the gear tips of the hinge members, automatically aligning the bearing for receiving the clamp edges as the clamp is slid thereover. At that point, insertion of a bearing into a recess is stopped, and the clamp can be slid over the hinges without having to align each bearing individually. Because the length of the lips are merely large enough to aid in the hinge assembly, they are not long enough to control or significantly affect rotation of the bearings within the clamp as the hinge members are loaded. The lips are usually shorter than 1/32 inches and less than 1/25 the length of the bearing body to avoid undue friction or interference with the motion of the gear sectors as the hinge is operated.

Thus, there remains a need for hinges that can prevent twisting of thrust bearings, and wear produced thereby, due to hinge members that are biased in opposite directions along the clamp length. The present invention provides solutions to this problem.

SUMMARY OF THE INVENTION

The invention provides a hinge in which a clamp and thrust bearings are adapted to resist unwanted bearing rotation caused by hinge members that are biased in opposite relative directions, overcoming the impracticality of closely fitting the entire cross-sectional profile of a thrust bearing within a clamp. Two hinge members are pivotably mounted about ends of a clamp of preselected length. Thrust bearings are disposed within recesses in both hinge members. These bearings prevent relative longitudinal movement between the hinge members along the length of the clamp. The thrust bearings have antirotation portions that restrict rotation of the bearings about an axis perpendicular to the clamp length. The antirotation portions maintain bearing surfaces that support recess surfaces of the hinge member recesses in flush contact with each other, even while the hinge members are oppositely loaded.

In an embodiment of the invention, one of the clamp and the bearings has a protrusion, such as a key, received by and mated with an opening, such as a keyway, in the other. The protrusion fits within the opening to resist torque generated on the bearing by the hinge members, restricting the rotation of the bearings about an axis normal to the clamp length. Preferably, an elongated key extends from the clamp, and a keyway is defined through the bearing, constituting the antirotation portion. The key and keyway are preferably configured so that the bearing may be slid along the key during hinge assembly.

The antirotation portion in another embodiment is a free extension on at least one side of a bearing body. The body is disposed within hinge member recesses for supporting the hinge members. The extension is free because it is integrally attached to a bearing body on only one of its sides, being free from integrally formed bearing-bodies on its other side. The extension of this embodiment is a longitudinal extension because it extends generally in the direction of the clamp length. It extends through the space between the clamp and the edges of the hinge members, resisting torque caused on the bearing by the hinge members when the extension abuts the clamp. That portion of the extension closest to the bearing body may be used to align the bearing within the recesses at a height controlled by the underside of the extension as it rests on a portion of the gear tips, but these extensions may be advantageously designed with a slight taper or step to provide sufficient clearance to avoid undue interference with the rotation of the hinge members.

The invention also provides a plurality of bearings having antirotation portions comprising free extensions that are configured and dimensioned for being meshed with each other. Torque generated on one bearing is transferred to adjacent, meshed bearings. The hinge members torque all bearings in a same direction, and the meshed extensions torque adjacent bearings in an opposite direction. As a result, the torque generated on each bearing by the hinge members is negated.

In a further embodiment, the meshable extensions are lockable to other bearings. This facilitates hinge assembly by connection of a chain of bearings which may then be placed in a single step in recesses of joined hinge members prior to sliding a clamp over the bearings and hinge members.

Preferably, the bearings are configured to engage extensions of substantially similar bearings. Thus, iterations of a commonly shaped bearing may be manufactured for use in a single hinge.

In another embodiment of the hinge, bearings overlap the adjacent bearing free extensions. Additionally, the overlapping bearings and extensions may be meshed to transfer torque therebetween, as in the above embodiment.

In a further embodiment, the clamp defines notches between clamp walls and a clamp base at the base of a channel. The notches permit inward or outward bending of the clamp walls, to accommodate variations in manufacturing dimensions, without altering the shape of the clamp base. The thrust bearings have recessed edges that define a wide key therebetween. This key slidably engages protruding lateral edges on the clamp base, which form a wide keyway able to maintain a precise fit regardless of the bending of the walls.

The notches also facilitate manufacturing. The clamp may be manufactured with large tolerances and the clamp walls may then be bent towards each other. The bending deformation will concentrate at the notch, permitting the clamp base to retain its original, intended shape.

Another embodiment has an antirotation portion that comprises lateral free extensions that extend across the length of the clamp to produce a better fit between the thrust bearing and the clamp. These lateral extensions may be flexible so that they are compressible or shearable by the clamp walls during assembly. The width of the thrust bearing through these lateral extensions is greater before the bearing is mounted in the clamp than once it is mounted to ensure that the initial width may be reduced substantially to that of the clamp channel.

DETAILED DESCRIPTION OF THE PREFERRED EMBODIMENTS

Figure 1:
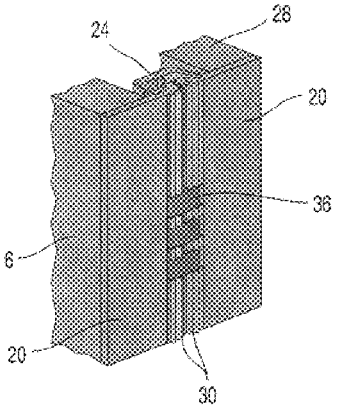
FIG. 1 is a fragmented perspective view of a hinge according to the present invention.
Figure 2:
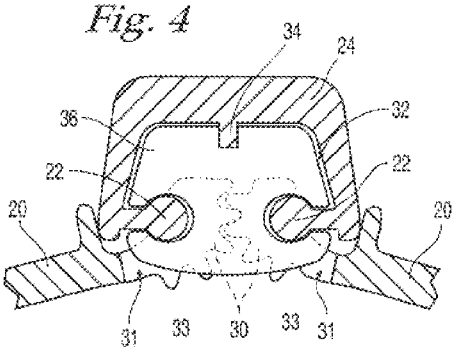
FIG. 2 shows a cross-sectional view through a preferred embodiment of the hinge.

Referring to FIG. 1, an embodiment of a hinge according to the invention has two hinge members 20. The hinge members 20 are rotatably engaged to two semicylindrical ends 22 of a clamp 24, as shown in FIG. 2. The hinge members 20 are fixed to hinged objects 26 and 28, such as a door and a door frame.

The edge portions of hinge members 20 are gear segments 30 that extend longitudinally, parallel to the length of the clamp 24. These gear segments 30 are mounted about the semicylindrical ends 22 of the clamp 24, which are at the axes of rotation of the hinge members 20. The clamp 24 retains the gear segments 30 in mesh and provides lateral support throughout the length of the hinge. Other embodiments can omit meshed gear segments.

In cross-section, the clamp 24 has an internal C-shaped channel 32. An elongated key 34 preferably extends along the entire length of the clamp 24, protruding into the channel 32.

Figure 4:
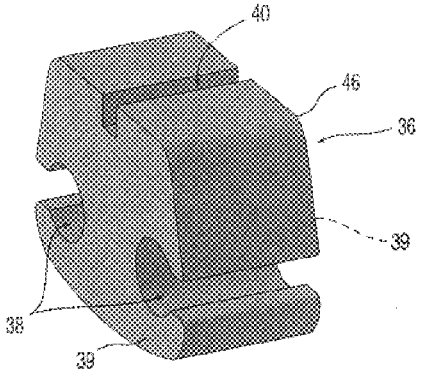
FIG. 4 is a perspective view of a bearing having a keyway.
Figure 3:
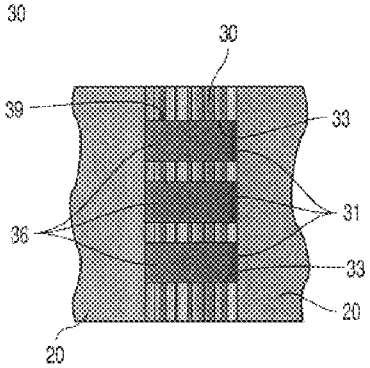
FIG. 3 illustrates a front view of an open hinge.

Recesses 31 extend through the gear segments 30 at various intervals, as seen in FIGS. 2 and 3, and are bound by opposing recess surfaces 33. To prevent relative, longitudinal movement between the hinge members 20, thrust bearings 36, as shown in detail in FIG. 4, are received in the clamp channel 32, within recesses 31 of both hinge members 20.

The longitudinal dimensions of the recesses 31 are large enough so that the thrust bearings 36 leave sufficient clearance therebetween for the hinge members 20 to pivot without binding on the bearings 36. The bearings 36 are preferably longitudinally thick enough to prevent their shearing by the hinge members 20 when they are biased under the opposing loads of the door and the frame.

Bearings 36 are formed with longitudinally extending slots 38 configured to receive the semicylindrical clamp ends 22. As seen in FIG. 2, the bearings 36 preferably largely fill the cross-section of the clamp channel 32.

Each bearing 36 has parallel bearing surfaces 39 disposed on opposite sides of the body 46 of the bearing 36. These bearing surfaces 39 abut and support the recess surfaces 33. The recess and bearing surfaces 33 and 39 preferably lie flush with one another to maximize the area of contact therebetween, reducing the pressure and wear on each surface 33 and 39. In another embodiment, these bearing surfaces comprise separate inserts, as disclosed in U.S. Pat. No. 4,976,008, which are assembled to form part of the body 46.

Relative longitudinal movement of the clamp 24 with respect to the hinge members 20 is preferably prevented by securing or fastening one or more thrust bearings 36 to the clamp 24, such as by means of a set screw, adhesives, or crimping.

The bearings 36 have a keyway 40 that extends in a longitudinal direction. FIG. 2 shows the clamp key 34 engaged in the keyway 40. The fit of the key 34 in the keyway 40 is sufficiently tight to prevent rotation of the bearings 36 about an axis perpendicular to the axes of rotation of the hinge members 20, caused by the torque acting upon the bearings 36 due to the oppositely loaded hinge members 20. As a result, the recess and bearing surfaces 33 and 39 are retained in flush contact with each other, preferably perpendicular to the clamp 24 length. On the other hand, the preferred fit between the key 34 and keyway 40 renders the bearings 36 slideable along the keyway 40, enabling assembly of the hinge by sliding the bearings 36 along the channel 23 while the key 34 and keyway 40 are engaged.

The key 34 and keyway 40 are not affected by variations in spacing between the semicylindrical ends 22 of the clamp 24. Thus, a fit sufficiently accurate to prevent bearing rotation within the clamp 24 may be manufactured that does not depend on other manufacturing considerations that necessitate altering the shape of other portions of clamp 24.

A preferred embodiment of the invention has a single key 34 and keyway 40, though alternative embodiments of the clamp and bearings have a plurality of parallel keys and keyways.

Figure 5:
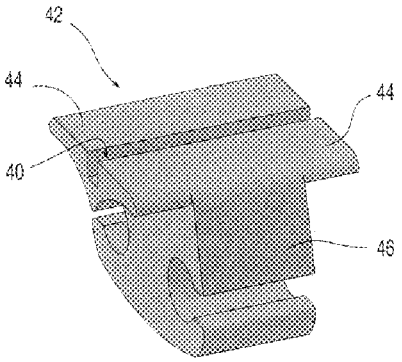
FIG. 5 is a perspective of a bearing having a longitudinal free extension at each end.

FIG. 5 displays a bearing 42 according to another embodiment of the invention. In addition to a keyway 40, bearing 42 has longitudinal free extensions 44 on both sides of a bearing body 46. The bearing body 46 itself is received by the hinge member recesses 31 in the assembled hinge. Although preferred bearings have a single body 46, alternative embodiments may comprise a plurality of bearing bodies joined by webs.

Figure 7:
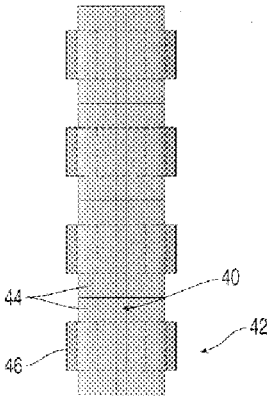
FIG. 7 shows hinge with a group of bearings of FIG. 5 with clamp and hinge members removed.
Figure 6:
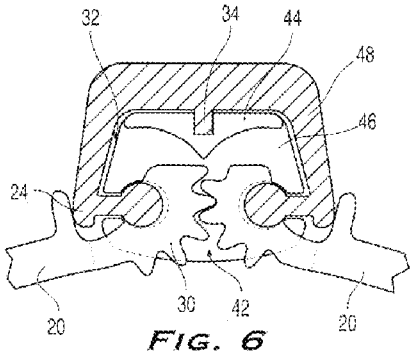
FIG. 6 illustrates a cross-section through an open hinge with the bearing of FIG. 5.

In FIG. 6, bearing 42 is shown mounted within clamp 24. Free extension 44 is disposed between the clamp 24 and the gear segment 30 edges of the hinge members 20. The extensions 44 of bearings 42 preferably occupy the entire available length between the bearing body 46 and adjacent bearings 42. FIG. 7 shows a plurality of bearings 42 as arranged in a hinge according to the invention, but for clarity, the clamp 24 and the hinge members 20 are not shown. Each extension 44 abuts an extension 44 of an adjacent bearing 42, preferably with only sufficient clearance therebetween to allow bearing surfaces 39 to properly seat against recess surfaces 33.

The free extensions 44 extend the effective length of the anti-rotation portions of the bearing. A small angle of rotation of the bearing 42 produces a significant displacement of the free extensions 44. The bearing 42 cannot rotate past the point at which the free extensions 44 contact a lateral wall 48 of the clamp. The free extensions 44 also lengthen keyway 40, increasing its antirotation effectiveness. Hence, longer extensions 44 limit bearing twist more effectively than do shorter extensions 44 and are therefore better adapted for resisting torque produced by the hinge members 20. The longitudinal length, parallel to the clamp length, of each extension 44 is preferably at least a quarter of the longitudinal length of the body 46. More preferably, the extensions 44 are at least a third, and most preferably at least two thirds, as long as the body 46. Also, the total longitudinal bearing length, including the length of both extensions 44, is preferably at least one and two thirds the length of the body 46.

Figure 8:
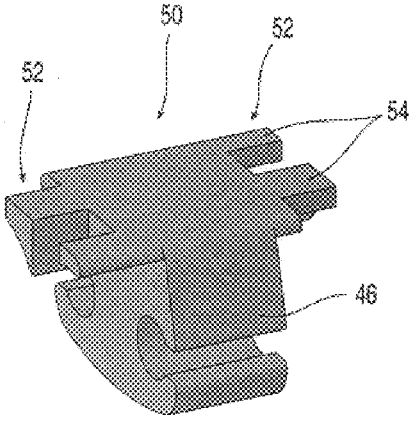
FIG. 8 is a perspective view of a bearing with extensions having fingers.
Figure 9:
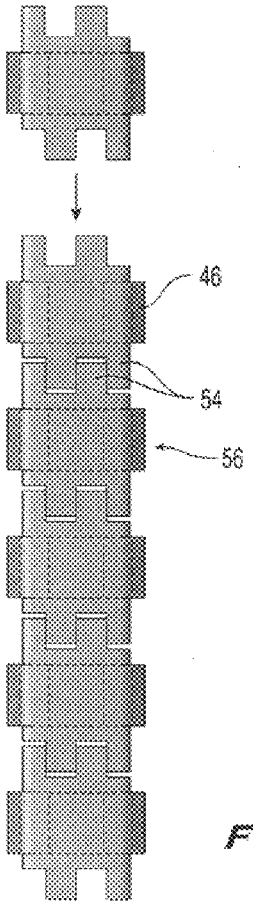
FIG. 9 shows a group of bearings of FIG. 8 with meshed extensions.

A further embodiment of thrust bearings 50 is shown in FIGS. 8 and 9. In this embodiment, bearing extensions 52 are meshable with other bearings 50. The bearings 50 of FIG. 9 are arranged according to the invention, but the clamp that receives the bearings 50 and the hinge members 20 have been omitted from the drawing for clarity. Each extension 52 has fingers 54 that mesh with fingers 54 of other similarly shaped, adjacent bearings 50.

In this embodiment, torque produced on one thrust bearing 50 is transferred to its adjacent bearings 50 through the meshed fingers 54. All bearings 50 in a hinge experience a torque in one same direction caused by the hinge members 20 when they are loaded. Through the extensions 52, however, bearings 50 apply a torque in the opposite direction, but with equal magnitude, on adjacent bearings 50 meshed therewith. This effect counteracts and negates bearing twisting caused by the hinge members 20, making the resistance to rotation less dependent on the fit between the interior of clamp 24 and the outer lateral dimensions of extensions 52. To ensure that the opposing torques are of substantially equal magnitude, the meshed extensions 52 of each bearing are preferably about equally long and of equally shear-resistant cross-sectional area.

Figure 10:
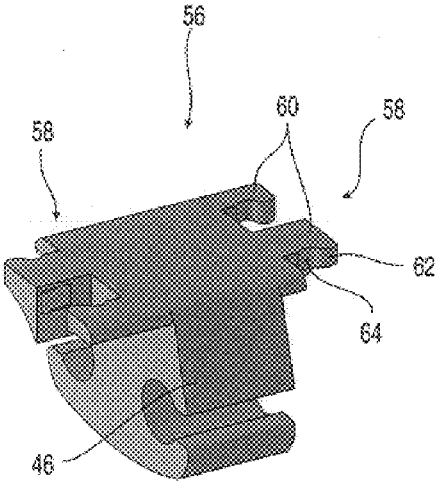
FIG. 10 illustrates a perspective view of a bearing with extensions that are lockable to other bearings.
Figure 11:
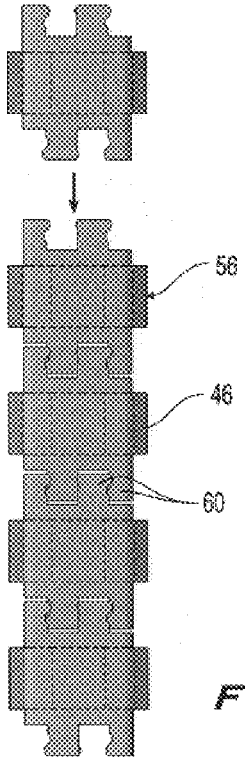
FIG. 11 displays a group of interlocked bearings.

Whereas the extensions 52 of bearings 50 are configured to slide smoothly into mesh with adjacent extensions 52, the extensions 58 of thrust bearings 56, illustrated in FIGS. 10 and 11, are formed to snap into locked mesh with adjacent extensions 58 when they are joined as shown in FIG. 11.

Fingers 60 of extensions 58 have locking protrusions 62 and locking depressions 64. The locking protrusions 62 are shaped to snap into and engage the locking depressions 64. When they are engaged, a group of bearings 56 are retainable in a continuous strand, preferably with a small amount of longitudinal end-play. This facilitates hinge assembly, as the entire group of bearings 56 may be joined and then placed in the hinge member recesses 31, prior to sliding a clamp 24 over the strand and hinge members 20.

Figure 12:
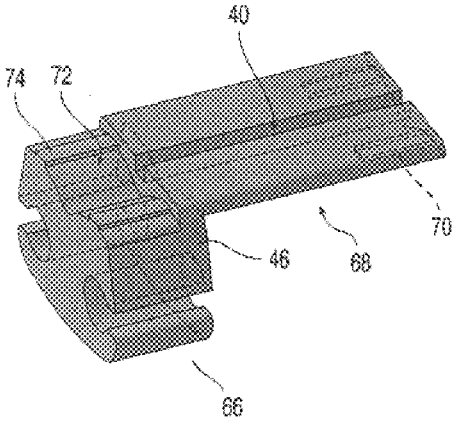
FIG. 12 is a perspective view of a bearing with an extension for overlapping with adjacent bearings.
Figure 13:
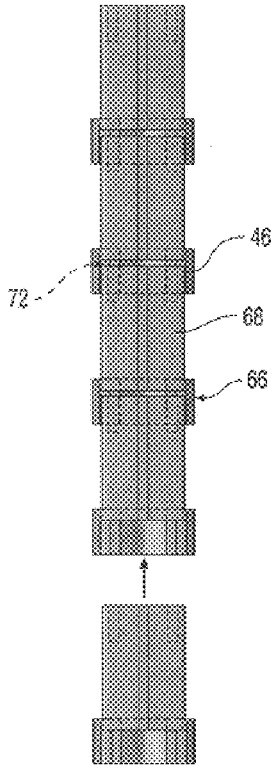
FIG. 13 shows a group of overlapping bearings.

FIG. 12 shows another embodiment. Bearing 66 has a free extension 68 configured to fit between a body 46 of an adjacent bearing 66 and the clamp 24. FIG. 13 shows a series of bearings 66, in which bodies 46 overlap free extensions 68. The free extensions 68 have longitudinal grooves 70, and the body 46 of each bearing 66 has a recessed underside 72 from which protrude longitudinal tongues 74. The grooves 70 are configured to receive and engage tongues 74 of adjacent bearings 66 that are overlapped therewith. This arrangement resists bearing rotation by meshing the bearings as in the embodiments of FIGS. 8–11. The embodiment also provides significantly long free extensions 68 occupying more than the space between bearing bodies 46 as the bearings 76 overlap, further limiting the bearing rotation. In addition, this embodiment resists rotation by engaging a key 34 of the clamp 24 in keyway 40 as in the embodiments of FIGS. 1 and 2.

Figure 14:
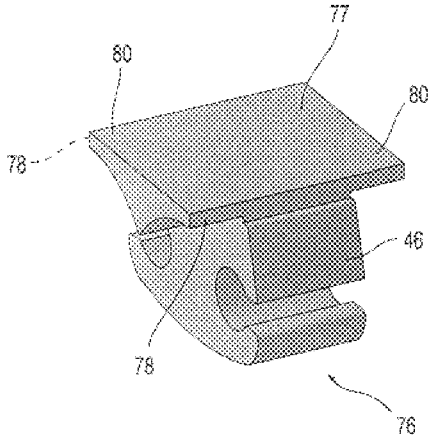
FIG. 14 is a perspective view of a bearing with lateral recessed edges.
Figure 15:
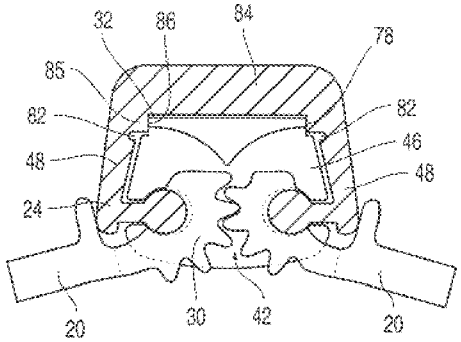
FIG. 15 illustrates a cross-section of an open hinge with the bearing of FIG. 14.
Figure 16:
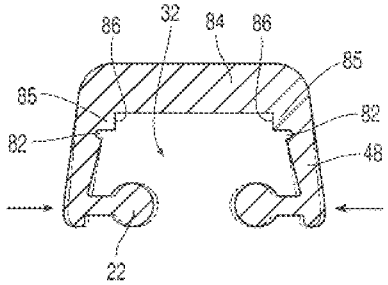
FIG. 16 shows the clamp member of FIG. 15 with notched walls.

The embodiment of FIGS. 14–16 provides a clamp and bearing arrangement in which the channel 32 at the base 84 the clamp 24 is unaffected by spreading or bringing together lateral clamp walls 48. The base 77 of the bearing 76 has recessed edges 78 that extend along the sides of extensions 80 and along the base of the body 46, defining a wide key therebetween. The cross-section of the clamp channel 32 at the clamp base 84 corresponds to the bearing base 77 of bearing 76. As shown in FIG. 15, clamp base 84, has opposed ledges 85 with lateral walls 86 protruding into the channel 32, defining a wide keyway therebetween. The walls 86 receive the recessed bearing edges 78 of the bearing base 77.

A notch 82 extends longitudinally along the length of the clamp 24, between the clamp base 84 and the clamp walls 48. These notches 82 permit clamp walls 48 to bend inwardly or outwardly without altering the shape of clamp base 84. As a result, the fit between bearing 76 and the clamp base 84 is unaltered by variations in the spacing between the semicylindrical ends 22, as can be seen in FIG. 16. Thus, even though the distance between semicylindrical ends 22 may require resizing, to accommodate anodizing or paint coatings, the width of channel 32 at the clamp base 84 will remain substantially constant.

Figure 17:
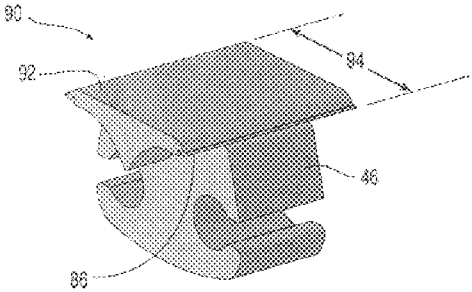
FIG. 17 is a perspective view of a thrust bearing with lateral and longitudinal free extensions.
Figure 18:
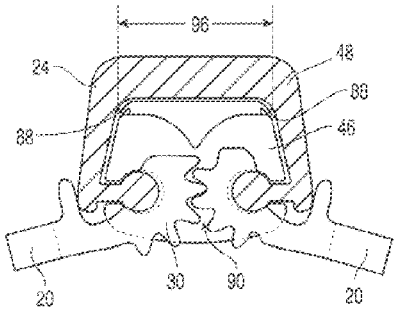
FIG. 18 illustrates a cross-section of an open hinge with the bearing of FIG. 17.

FIGS. 17–20 show two embodiments of thrust bearings according to the invention, which have free extensions 88 that extend laterally, in a direction across the clamp length when the hinge is assembled and thrust bearings are mounted therein. Referring to FIGS. 17 and 18, thrust bearing 90 has two lateral free extensions 88, in addition to two longitudinal free extensions 92. The lateral free extensions 88 are disposed along the entire length of the bearing body 46 and of the longitudinal free extensions 92, preferably at the base of the bearing.

FIG. 17 shows the thrust bearing 90 before it is mounted in the clamp 24. This figure shows an unmounted width 94 of the thrust bearing 90 measured through the lateral free extensions 88. FIG. 18 shows the mounted width 96 of the thrust bearing 90 when the bearing 90 is mounted within the clamp 24. Both widths 94 and 96 are defined in a direction across, or perpendicular to, the clamp length. The unmounted width 94 is larger than the mounted width 96. This difference in widths 94 and 96 permits the dimensions of the thrust bearing 90 to be tailored to the cross-section of the clamp 24 to produce a snug fit that still permits hinge assembly by sliding the thrust bearings along the length of the clamp, but which ensures that the sides of the thrust bearing 90 laterally abut the walls 48 of the clamp 24. This contact, in turn, eliminates play between the thrust bearing 90 and the clamp 24 by reducing gaps therebetween, and thus better resists rotation of the thrust bearing 90 therein.

This difference in widths 94 and 96 is preferably attained in one of two ways. The lateral extensions 88 may be configured so that they are shearable by the clamp 24 itself, as they are slid into the clamp during mounting. Thus, the portions of the lateral extensions 88 that extend further than the inside of the clamp are sheared off during assembly. Alternatively, the lateral extensions 88 may be flexible, so that when they are mounted in the clamp 24, the lateral extensions are compressed to the smaller mounted width 96. In embodiments in which the lateral extensions 88 are flexible, they are preferably resiliently biased against the clamp 24 once they are mounted. Both of these arrangements improve the fit between clamp and bearing, regardless of manufacturing tolerances or shape changes of the clamp 24 prior to hinge assembly.

Figure 19:
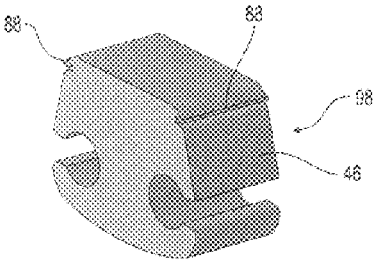
FIG. 19 shows a perspective view of a thrust bearing with lateral free extensions.
Figure 20:
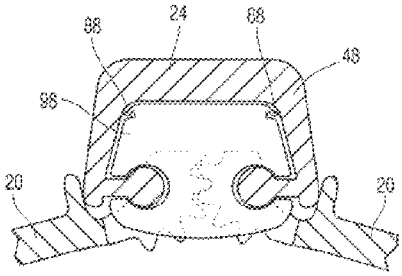
FIG. 20 shows a cross-section of an open hinge with the bearing of FIG. 19.

FIGS. 19 and 20 show a thrust bearing 98 similar to the one of FIGS. 17 and 18, but lacking longitudinal extensions. The lateral extensions 88 of thrust bearing 98 function similarly to the ones of thrust bearing 90.

Preferably, all bearings used in a hinge of the invention are identical. Consequently, numerous similar bearings may be manufactured, and the order in which these bearings are assembled into the hinge does not affect the hinge operation. Alternatively, when extensions are provided, the first and last bearings may have extensions on only one side of their bodies.

Any of a wide variety of bearing arrangements can be included in a hinge. For example, a single bearing can be used, or multiple, spaced single bearings can be included. For higher performance hinges, a plurality of adjacent bearings, either in one place or in multiple spaced locations along the hinge, are possible. Of course, the entire length of the hinge can be provided with adjacent single or multiple bearings that are either separate or connected.

One of ordinary skill in the art can envision numerous variations and modifications, all of which are contemplated by the true spirit and scope of the following claims.

What is claimed:

1. A hinge comprising:

a clamp of preselected length;

first and second hinge members each having a recess and being pivotably engaged with the clamp about the clamp length;

a thrust bearing mounted with the clamp and having:

a body disposed within the recesses for preventing relative movement between the hinge members substantially along the clamp length, and an antirotation portion that comprises at least one lateral free extension extending from the body across the clamp length for resisting torque caused on the thrust bearing by the hinge members;

wherein the thrust bearing has a mounted width measured through the lateral free extension when the thrust bearing is mounted within the clamp, and an unmounted width measured through the lateral free extension when the thrust bearing is separate from the clamp, the mounted width being smaller than the unmounted width, wherein the lateral free extension laterally abuts the clamp when the thrust bearing is mounted within the clamp.

2. The hinge of claim 1, wherein the clamp has a first matable portion, and the thrust bearing comprises a second matable portion matable with the first matable portion, the antirotation portion comprising the first and second matable portions.

3. The hinge of claim 2, wherein one of the matable portions comprises a key and the other portion comprises a keyway.

4. The hinge of claim 1, wherein the thrust bearing comprises at least one longitudinal free extension protruding from the bearing body along the clamp length for contacting the clamp for restricting rotation of the thrust bearing about an axis generally perpendicular to the clamp length.

5. The hinge of claim 1, wherein the clamp has a clamp base connecting two clamp walls and defining a longitudinal notch extending between at least a first of the clamp walls and the clamp base such that the clamp base retains substantially a same shape during a selected bending of the first clamp wall, the antirotation portion including the clamp base.

6. The hinge of claim 1, wherein the free extension is shearable by the clamp during mounting therein.

7. The hinge of claim 1, wherein the free extension is compressed by the clamp when mounted therein.

8. A hinge comprising:

a clamp of preselected length having a clamp base connecting two clamp walls;

first and second hinge members each having a recess and being pivotably engaged with the clamp about the clamp length; and a thrust bearing mounted with the clamp and within the recesses for preventing relative movement between the hinge members substantially along the clamp length;

wherein one of the clamp base and the thrust bearing has a first antirotation portion comprising a protrusion while the other has a second antirotation portion defining an opening in which the protrusion is receivable, the protrusion and the second antirotation portion being capable of lateral contact with each other within the opening for restricting rotation of the bearing about an axis perpendicular to the clamp length.

9. The hinge of claim 8, wherein the thrust bearing comprises a meshable portion that is configured and dimensioned to be meshable with an adjacent bearing for transferring torque therebetween.

10. The hinge of claim 8, wherein the protrusion and the opening are configured and dimensioned for resisting torque generated on the bearing by the hinge members.

11. The hinge of claim 8, wherein the hinge members have hinge member recess surfaces that define the hinge member recesses therebetween, and the thrust bearing has a bearing surface aligned with at least one of the hinge member recess surfaces for abutting the at least one of the hinge member recess surfaces in flush contact therewith for supporting one of the hinge members, with the protrusion and the opening being configured for retaining said flush contact when the hinge members are loaded in opposite directions along the clamp length.

12. The hinge of claim 8, wherein the thrust bearing has two parallel bearing surfaces disposed on opposite sides thereof for abutting the hinge members, with the protrusion and the opening being configured for maintaining the thrust bearing surfaces substantially perpendicular to the clamp length.

13. The hinge of claim 8, wherein the protrusion is an elongated key and the opening is a keyway, the key being slidable within the keyway.

14. The hinge of claim 13, wherein the key extends from the thrust bearing.

15. The hinge of claim 13, wherein the key extends from the clamp base.

16. The hinge of claim 8, wherein the clamp base defines a longitudinal notch extending between at least a first of the clamp walls and the clamp base such that the clamp base retains substantially a same shape during a selected bending of the first clamp wall.

17. A hinge comprising:

a clamp of preselected length;

first and second hinge members each having a first recess and being pivotably engaged with the clamp about the clamp length; and a first thrust bearing mounted with the clamp and having:

a body of a body length parallel to the clamp length and disposed within the first recesses for preventing relative longitudinal movement between the hinge members, and an antirotation portion that comprises a first free extension extending from the body along the clamp length by an extension length that is at least about a quarter of the body length and sufficient for laterally contacting the clamp for resisting torque caused on the first thrust bearing by a longitudinal bias on the hinge members.

18. The hinge of claim 17, wherein the free extension of the antirotation portion is configured and dimensioned for resisting said torque when the extension abuts the clamp.

19. The hinge of claim 17, wherein the clamp has a clamp base connecting two clamp walls, the clamp base and the clamp walls defining a channel of a lateral width and defining a longitudinal notch extending between at least a first of the clamp walls and the clamp base configured such that the width of the channel at the clamp base remains substantially unaltered during a selected bending of the first clamp wall, the first thrust bearing being disposed within the channel.

20. The hinge of claim 17, wherein the first thrust bearing comprises a second free extension which is disposed opposite the body from the first extension.

21. The hinge of claim 17, wherein the first free extension is configured and dimensioned to be meshable with an adjacent bearing for transferring torque therebetween.

22. The hinge of claim 21, further comprising a second thrust bearing meshed with the first thrust bearing, wherein each bearing produces a torque on the other in a direction opposite and in response to a torque produced by the hinge members on the bearings.

23. The hinge of claim 21, wherein the first free extension is configured and dimensioned to be lockable to the adjacent bearing.

24. The hinge of claim 21, further comprising a second thrust bearing having a locking depression, wherein the first thrust bearing has a locking protrusion engageable to the locking depression for locking first and second bearings to each other.

25. The hinge of claim 17, wherein one of the clamp and the first bearing has a protrusion while other defines an opening, the protrusion being engageable in the opening for restricting rotation of the first bearing about an axis perpendicular to the clamp length.

26. The hinge of claim 17, wherein the hinge members each have hinge member edge portions that are rotatably mounted about the clamp, and the first free extension extends between the hinge member edge portions and the clamp.

27. The hinge of claim 26, further comprising a second thrust bearing, wherein the first free extension extends substantially to the second thrust bearing.

28. The hinge of claim 17, further comprising a second thrust bearing configured and dimensioned for overlapping the first free extension.

29. The hinge of claim 17, wherein the first extension extends from the bearing body across the clamp length.

30. The hinge of claim 29, wherein the first thrust bearing has a mounted width measured through the first free extension when the first thrust bearing is mounted within the clamp, and an unmounted width measured through the first free extension when the first thrust bearing is separate from the clamp, the mounted width being smaller than the unmounted width, wherein the first free extension laterally abuts the clamp when it is mounted within the clamp.

31. A hinge comprising:

a clamp of preselected length;

first and second hinge members each having a recess and being pivotably engaged with the clamp about the clamp length; and a first thrust bearing mounted with the clamp and within the hinge member recesses for preventing relative movement between the hinge members substantially along the clamp length, the first thrust bearing being configured and dimensioned to be lockable to at least one adjacent bearing.

32. The hinge of claim 31, further comprising the adjacent thrust bearing, which has a locking depression, wherein the first thrust bearing has a locking protrusion lockably engageable with the locking depression.

33. The hinge of claim 31, wherein the first thrust bearing comprises a plurality of thrust bearings locked with each other along the clamp length.

34. A hinge comprising:

a thrust bearing;

a clamp of preselected length having:

a base with inner walls spaced from each other and facing in generally opposite directions engaging the thrust bearing, two side walls each connected to the base, wherein the base and the side walls define a channel, and a longitudinal notch extending between at least a first of the side walls and the clamp base and configured and dimensioned such that the spacing of the inner walls from each other remains substantially unaltered during a selected bending of the first clamp side wall with respect to the base; and first and second hinge members pivotably engaged with the clamp about the clamp side walls, wherein the thrust bearing is engaged between the hinge members in the channel.

35. The hinge of claim 34, wherein the notch is configured for minimizing deformation of the clamp base during the bending of the first clamp wall.

36. The hinge of claim 35, wherein the thrust bearing has a bearing base with at least one recessed edge that extends along a side thereof, and the clamp base has a lateral ledge protruding into the channel and configured for engaging the recessed edge of the bearing base for resisting bearing rotation.

37. The hinge of claim 34, wherein:

the inner walls face each other and define a base channel width therebetween; and the notch is configured and dimensioned such that the base channel width remains substantially unaltered during a selected bending of the first clamp side wall with respect to the base.

38. A hinge comprising:

a clamp of preselected length;

first and second hinge members each having first and second recesses and being pivotably engaged with the clamp about the clamp length;

a first thrust bearing mounted with the clamp and in the first recesses for preventing relative longitudinal movement between the hinge members; and a second thrust bearing having:

a body disposed within the second recesses for preventing relative longitudinal movement between the hinge members, and at least one free extension extending from the body and disposed between the second thrust bearing and the clamp in overlap with the first thrust bearing.

* * * * *